US007090539B1

(12) United States Patent
Mazur

(10) Patent No.: US 7,090,539 B1
(45) Date of Patent: Aug. 15, 2006

(54) SOCKET ADAPTOR INSERTION-REMOVAL TOOL

(76) Inventor: Robert Mazur, 4493 Lakewood Boulevard, Naples, FL (US) 34112

( * ) Notice: Subject to any disclaimer, the term of this patent is extended or adjusted under 35 U.S.C. 154(b) by 0 days.

(21) Appl. No.: 11/167,298

(22) Filed: Jun. 28, 2005

(51) Int. Cl.
*H01R 25/00* (2006.01)

(52) U.S. Cl. ..... 439/651; 439/477

(58) Field of Classification Search ..... 439/646, 439/650, 651, 477, 478
See application file for complete search history.

(56) References Cited

U.S. PATENT DOCUMENTS

| | | | | |
|---|---|---|---|---|
| 1,023,077 | A | 4/1912 | Grout | |
| 1,719,311 | A | 7/1929 | Sargent | |
| 2,253,668 | A * | 8/1941 | Weddle | 174/69 |
| 2,687,567 | A | 8/1954 | Walraven | |
| 2,764,160 | A | 9/1956 | Alexander et al. | |
| 2,799,082 | A | 7/1957 | Mann | |
| 3,496,422 | A * | 2/1970 | Horowitz | 361/211 |
| 4,183,604 | A | 1/1980 | Tjornhom | |
| D256,442 | S | 8/1980 | Martin | |
| D261,595 | S | 11/1981 | Yellin | |
| 4,332,409 | A | 6/1982 | Stachowicz | |
| 4,649,613 | A | 3/1987 | Bednarik | |
| 5,007,857 | A * | 4/1991 | Wright | 439/490 |
| 5,044,974 | A * | 9/1991 | Pelton et al. | 439/307 |
| 5,599,204 | A * | 2/1997 | Glassford | 439/502 |
| 5,700,154 | A * | 12/1997 | Geary | 439/236 |
| 5,926,948 | A | 7/1999 | Pong | |
| 6,108,901 | A | 8/2000 | Kossor | |
| 6,249,960 | B1 | 6/2001 | Faesel | |
| 6,269,535 | B1 | 8/2001 | McHugh et al. | |
| 6,324,741 | B1 | 12/2001 | Brown | |
| 6,485,074 | B1 | 11/2002 | Floyd | |
| 2003/0192173 | A1 | 10/2003 | Whitehead | |
| 2004/0205960 | A1 | 10/2004 | Miyazaki | |

FOREIGN PATENT DOCUMENTS

| | | |
|---|---|---|
| DE | 4013917 | 10/1991 |
| JP | 06-096834 | 4/1994 |

OTHER PUBLICATIONS

ZIRCON CF12 Circuit Finding Kit, retrieved on Oct. 26, 2004 www.zircon.com/support/PDS/CF12pro/CF12pro_PDS.html.
Lisle Electrical Connector www.sjdiscounttools.com/lis13120.html, retrieved on Oct. 25, 2004.

* cited by examiner

*Primary Examiner*—James R. Harvey
(74) *Attorney, Agent, or Firm*—Richard C. Litman

(57) ABSTRACT

The socket adaptor insertion-removal tool including a handle, a depending shank terminating in a head with at least two conducting prongs wired to a receptacle in the handle top, for insertion into a socket adaptor, thus to provide electrical power from the receptacle in the top of the handle upon insertion of the socket adaptor into an electrical socket. In another embodiment, the handle top end does not have a receptacle.

7 Claims, 3 Drawing Sheets

SOCKET ADAPTOR INSERTION-REMOVAL TOOL

BACKGROUND OF THE INVENTION

1. Field of the Invention

The present invention relates to a tool for insertion and removal of electrical socket adaptors.

2. Description of the Related Art

Often times consumers attempt to install or remove electrical socket adaptors from very tight spots, not easily reached by hand. One common example is the insertion of adaptors for use with holiday lighting strings. Usually consumers attempt to install these lights using an outdoor lighting fixture as a power source. Outdoor lighting fixtures frequently have a narrow convex shape, which means that it is difficult to place the average sized hand down in there to install the plug adaptor. Once the adaptor is installed, it again becomes difficult to take the plug from the lighting string and plug it into the adaptor which is now in a tight spot. Upon time to remove the lighting string, the whole difficult process repeats itself in reverse. The consequences of the entire procedure may be as severe as a scraped or bruised hand, but the consequences are always a degree of frustration by not being able to easily insert and remove the plug adaptor.

Thus, a socket adaptor insertion-removal tool solving the aforementioned problems is desired.

SUMMARY OF THE INVENTION

The invention is a socket adaptor insertion-removal tool, comprising: a handle having a top and a bottom; the handle bottom having a shank with an upper end and a lower end; the lower end of the shank formed with a head having at least two conducting prongs wired to a receptacle in the handle top, for insertion into a socket adaptor, wherein the socket adaptor insertion-removal tool can be employed to easily insert and remove an electrical socket adaptor into and out of a socket. When the socket adaptor is inserted with the tool, the tool becomes an adaptor extender, due to the fact that the conducting prongs are wired to a receptacle in the top of the tool handle. Thus, for example, a light bulb socket in a fixture which is recessed in a cavity is converted into a socket that can receive a multi pronged electrical plug, the plug connection being extended into the top of the tool handle to provide an easy access plug receptacle away from the fixture cavity. By a reverse procedure, the tool can later be used to easily remove the adaptor from the fixture.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
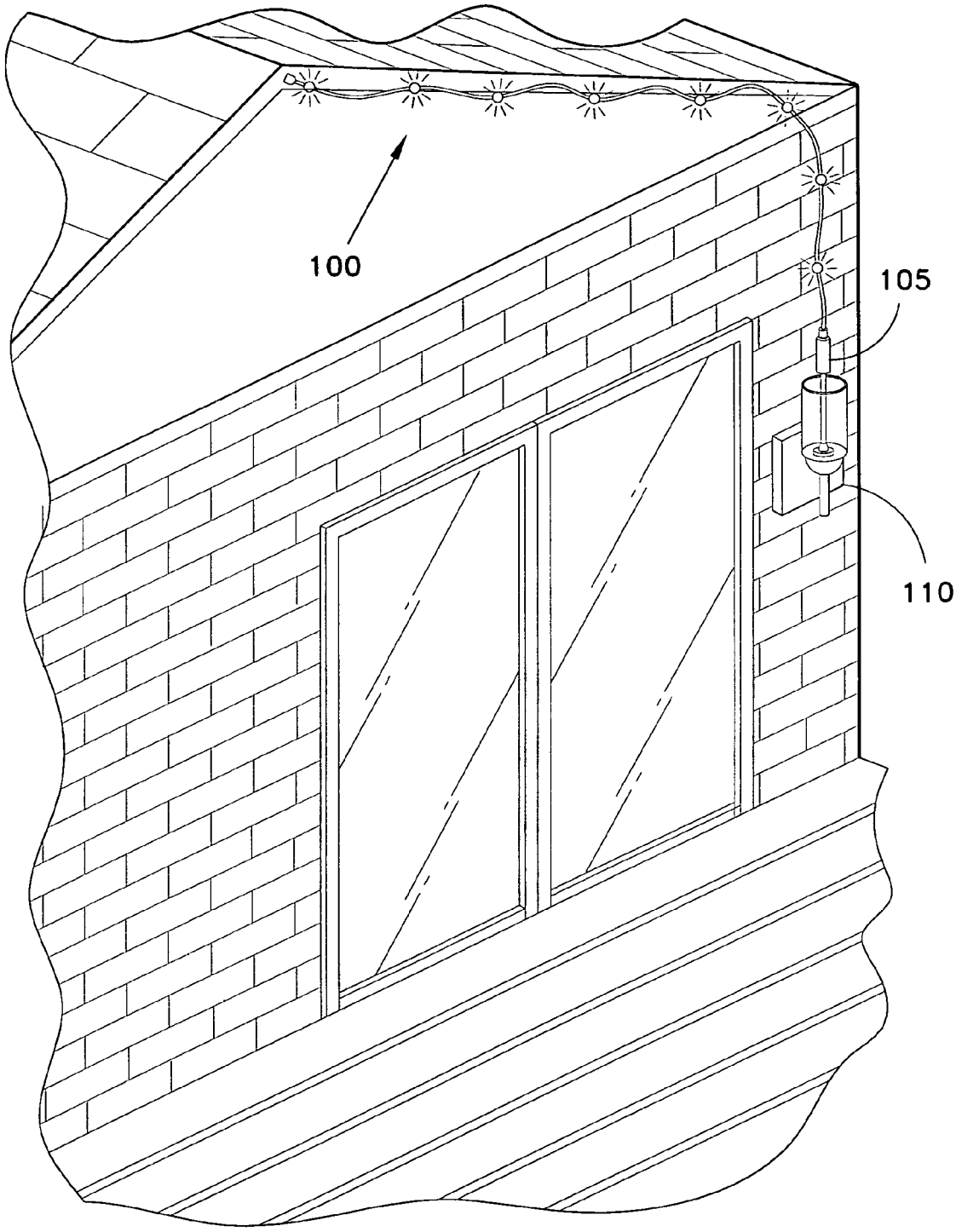
FIG. 1 is an environmental, perspective view of a socket adaptor insertion-removal tool plugged into a fixture, and powering lights in the environment, according to the present invention.

As can be seen in FIG. 1, the tool 105 of the instant invention is a plugged into a fixture 110, and powers lights in a string 100, th lights being strung out along the roof edge of a home. This illustration simply shows just one of many ways the invention may be employed.

The socket adaptor insertion-removal tool 105 includes a handle 205 with a top 210 and a bottom 214. The handle bottom 214 has a depending shank 215 with an upper end 217 and a lower end 219. The lower end 219 of the shank 215 has a head 225 with at least two conducting prongs 230 for insertion into a socket adaptor 240. The electrically conducting prongs 230 are wired with electrically conducting wires 235 connecting to a receptacle 213 in the top 210 of the handle 205, so that the socket adaptor insertion-removal tool 105 functions as an adaptor extender, providing electrical power from the receptacle in the top of the handle 213 upon insertion of the socket adaptor 240 into an electrical socket 245 by the socket adaptor insertion-removal tool 105.

Figure 2:
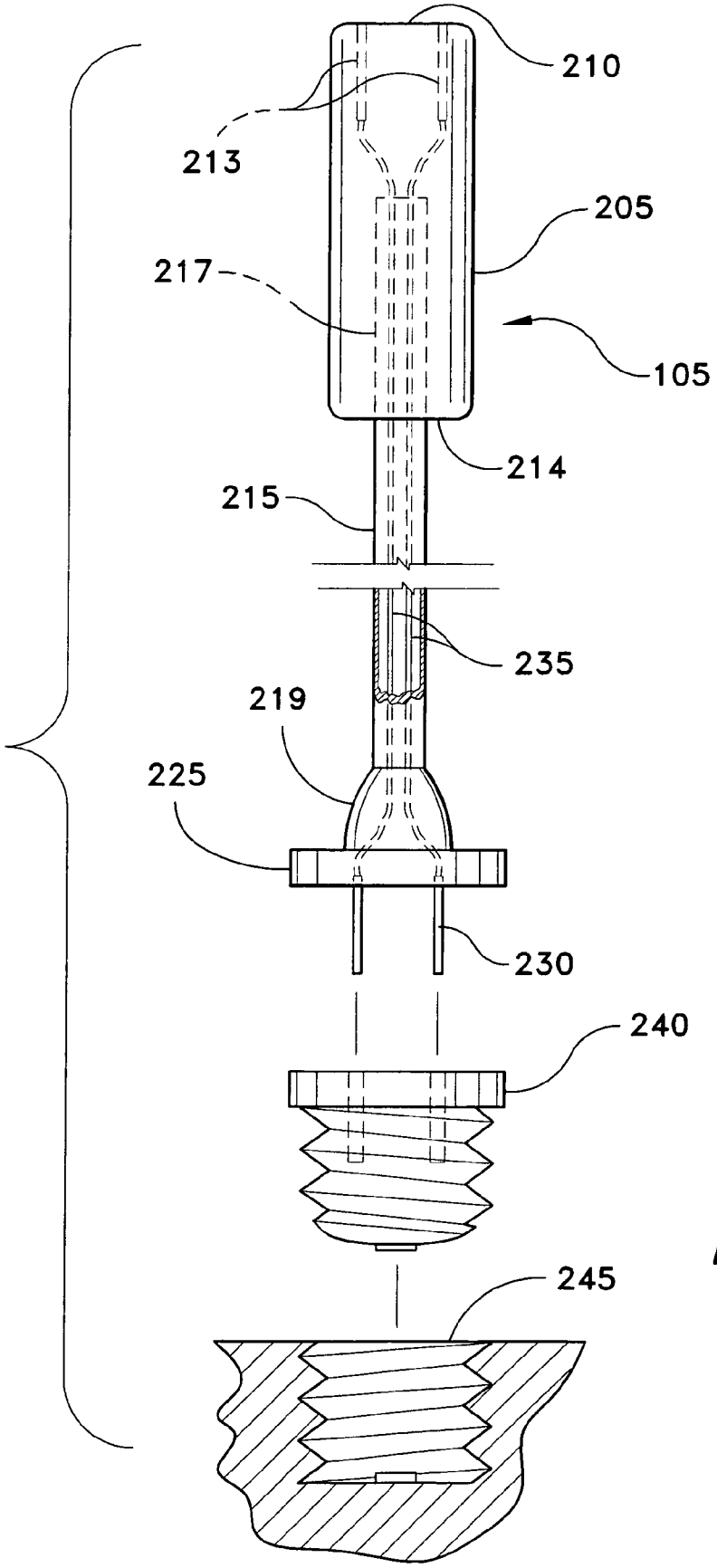
FIG. 2 is a preferred embodiment of the present invention.

According to the present invention, the socket adaptor insertion-removal tool provides an easy access plug receptacle away from a cavity of a fixture, or other tight spot that is suitable for insertion of the tool. A reverse process from the insertion process is used to remove the socket adaptor insertion-removal tool, and attached adaptor. For example, as shown in FIG. 2 at 240 and 245, when the adaptor to be used is a screw type adaptor 240, the socket adaptor insertion-removal tool 105 is first plugged into the adaptor 240. Then by using the socket adaptor insertion-removal tool 105, the adaptor 240 is screwed into the electrical socket 245. Electrical power is then provided from the receptacle in the top of the handle 213.

To remove the assembly, the socket adaptor insertion-removal tool 105, while still being connected to the socket adaptor 240, is unscrewed from the electrical socket 245. Additionally, within the scope of the present invention, the socket adaptor insertion-removal tool can also provide the same function of easy insertion, power adaptation, and easy removal of non-threaded socket adaptors that adapt to non-threaded electrical sockets, e.g., the socket adaptor insertion-removal tool 105 can also be used with a push and click, push and twist, and the like non-threaded adaptor. Moreover, it is within the scope of the present invention to provide electrical power to the receptacle in the top of the handle 213 through the use of any type of electrically conducting material connecting the prongs 230 to the receptacle 213; e.g., the prongs 230 could be connected to the receptacle 213 by electrical conductors, such as electrically conducting metal strips, electrically conducting metal tubes, and the like.

It is also within the scope of the present invention to use a handle of sufficient strength such that a shank might not be employed. For example, the handle may be of sufficient strength and sufficient length so that the handle bottom 214 runs all the way down and is integral with the head 225. Electrical conductors connecting the prongs 230 to the receptacle 213 would then run through most of the length of the handle, preferably through channels in the handle, yet provide all of the functionality of the socket adaptor insertion-removal tool 105 heretofore discussed.

To facilitate safe usage of the tool 105, the socket adaptor insertion-removal tool 105 may have the handle made of a non-conductive material. Additionally, the shank 215 may be made of a non-conductive material. The shank 215 may be hollowed out to accommodate the electrically conducting wires 235 or other electrical conductors connecting the prongs 230 to the receptacle 213. The wires 235 or other electrical conductors may then be channeled through the hollowed out portion of the shank. For additional safety and protection, the electrically conducting wires 235 or other electrical conductors may have an electrically insulating sheath. For even further safety and protection, the tool head 225 may be made of an electrically non-conducting material.

Figure 3:
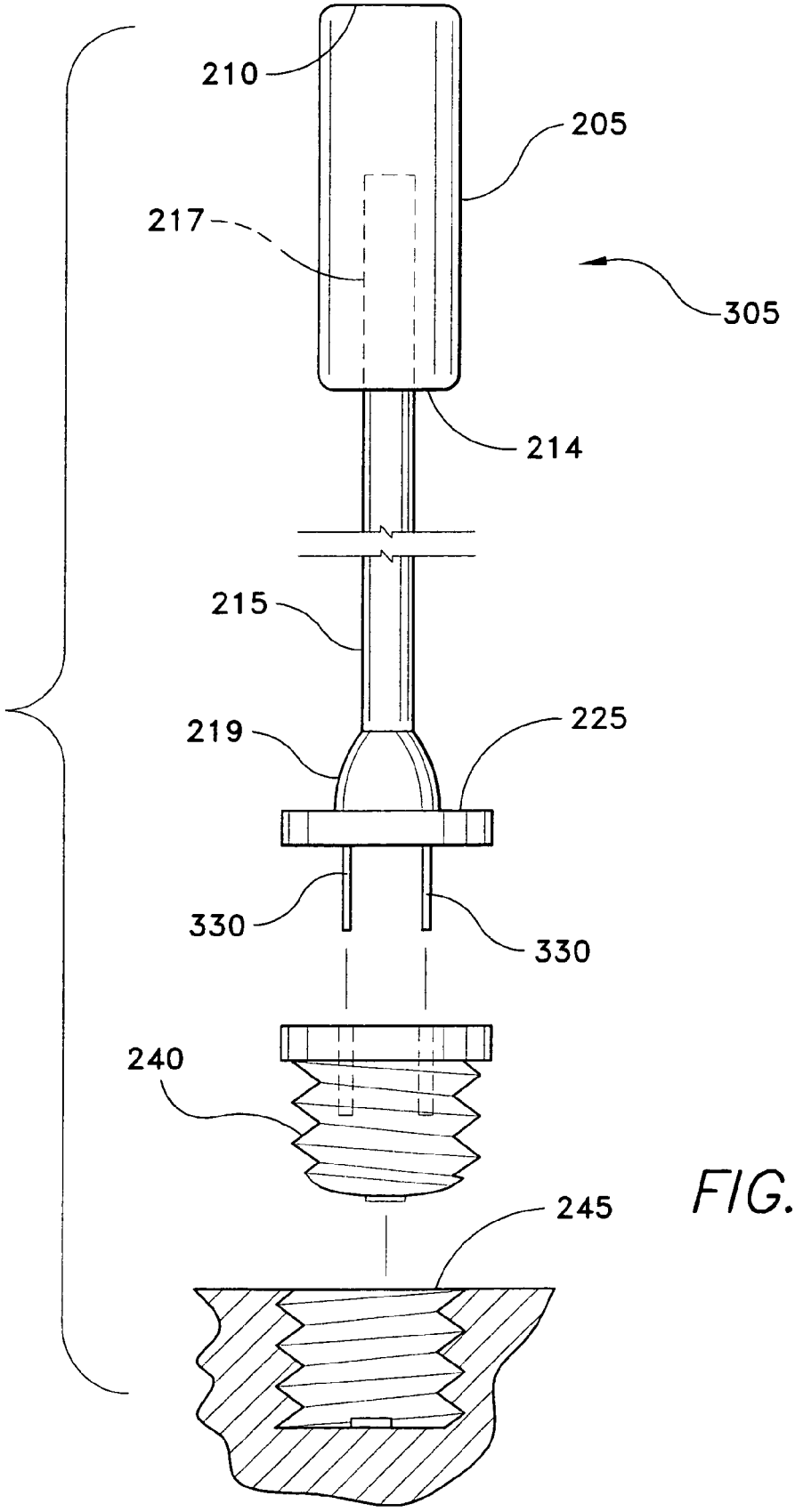
FIG. 3 is a perspective view of a second embodiment of the present invention.

Alternatively, and as shown in FIG. 3, a socket adaptor insertion-removal tool 305 is shown but without a handle receptacle. The handle 205 has a top 210 and a bottom 214. The handle bottom 214 has a shank 215 with an upper end 217 and a lower end 219. The lower end 219 of the shank 215 includes a head 225 with at least two electrically isolated prongs 330 for insertion into a socket adaptor 240. Thus, the socket adaptor insertion-removal tool may be employed to easily insert and remove the socket adaptor 240 into and out of the socket 245.

The insertion-removal tool 305 functions the same as the insertion-removal tool 105, except that the insertion-removal tool 305 does not provide power adaptation in the tool. In the tool 305, if the prongs 330 are electrically conducting, they should be electrically isolated from each other and from the rest of the tool 305, i.e., head, shank and handle, in order to provide an open circuit that draws no current when the tool 305 is used to insert a socket adaptor such as, for example, adaptor 240. Non-electrically conducting prongs could also be used in the tool 305, thus automatically providing the required electrical isolation.

In both embodiments, the handle, shank and head parts may be integrally cast of any suitable, non-conductive material, with the wires being cast internally, so that the tool is, essentially, a one-piece unit.

It is to be understood that the present invention is not limited to the embodiments described above, but encompasses any and all embodiments within the scope of the following claims.

I claim:

1. A socket adaptor insertion-removal tool, comprising:

a handle having a top and a bottom, the handle top having a receptacle;

an elongated shank of unitary construction depending from the handle bottom, the shank being in vertical alignment with the handle and including an upper end and a lower end, the lower end of the shank terminating in a head; and the head having at least two electrically conducting prongs for insertion into a socket adaptor, the electrically conducting prongs being in vertical alignment with the shank and having internal, electrically conducting wires connecting to the receptacle in the top of the handle;

whereby, the socket adaptor insertion-removal tool functions as an adaptor extender, providing electrical power from the receptacle in the top of the handle upon insertion of the socket adaptor into an electrical socket by the socket adaptor insertion-removal tool.

2. The socket adaptor insertion-removal tool as claimed in claim 1, wherein the handle is made of a non-conductive material.

3. The socket adaptor insertion-removal tool as claimed in claim 1, wherein the shank is made of a non-conductive material.

4. The socket adaptor insertion-removal tool as claimed in claim 1, wherein the shank includes a hollowed out portion to accommodate the electrically conducting wires connecting the prongs to the receptacle.

5. The socket adaptor insertion-removal tool as claimed in claim 1, wherein each of the wires has an electrically insulating sheath.

6. The socket adaptor insertion-removal tool as claimed in claim 1, wherein the head is made of an electrically non-conducting material.

7. The socket adaptor insertion-removal tool as claimed in claim 4, wherein the wires are channeled through the hollowed out portion of the shank.

* * * * *